US008860621B2

(12) United States Patent
Zhang

(10) Patent No.: US 8,860,621 B2
(45) Date of Patent: Oct. 14, 2014

(54) DIPOLE ANTENNA AND MOBILE COMMUNICATION TERMINAL

(75) Inventor: Haixia Zhang, Shenzhen (CN)

(73) Assignee: ZTE Corporation, Shenzhen, Guangdong Province (CN)

( * ) Notice: Subject to any disclaimer, the term of this patent is extended or adjusted under 35 U.S.C. 154(b) by 143 days.

(21) Appl. No.: 13/634,283

(22) PCT Filed: Sep. 14, 2010

(86) PCT No.: PCT/CN2010/076888

§ 371 (c)(1),
(2), (4) Date: Sep. 12, 2012

(87) PCT Pub. No.: WO2011/137616

PCT Pub. Date: Nov. 10, 2011

(65) Prior Publication Data

US 2013/0038499 A1 Feb. 14, 2013

(30) Foreign Application Priority Data

May 4, 2010 (CN) ..... 2010 2 0186342 U

(51) Int. Cl.

| | |
|---|---|
| ***H01Q 9/16*** | (2006.01) |
| ***H01Q 5/00*** | (2006.01) |
| ***H01Q 9/28*** | (2006.01) |
| ***H01Q 9/06*** | (2006.01) |
| ***H01Q 21/30*** | (2006.01) |

(52) U.S. Cl.

CPC ..... *H01Q 9/065* (2013.01); *H01Q 5/0055* (2013.01); *H01Q 9/285* (2013.01); *H01Q 5/0027* (2013.01); *H01Q 5/0086* (2013.01); *H01Q 21/30* (2013.01)

USPC ..... 343/795; 343/702; 343/742; 343/793; 343/867

(58) Field of Classification Search

CPC ..... H01Q 21/30; H01Q 5/27; H01Q 5/55; H01Q 5/86; H01Q 9/65; H01Q 9/285

USPC ..... 343/702, 741, 742, 793, 795, 866, 867

See application file for complete search history.

(56) References Cited

U.S. PATENT DOCUMENTS 4,518,965 A * 5/1985 Hidaka ..... 343/742
6,204,817 B1 * 3/2001 Edvardsson ..... 343/702

(Continued)

FOREIGN PATENT DOCUMENTS

CN 1617386 A 5/2005
EP 0797268 A2 9/1997

(Continued)

OTHER PUBLICATIONS

International Search Report for PCT/CN2010/076888 dated Jan. 17, 2011.

*Primary Examiner* — Tho G Phan

(74) *Attorney, Agent, or Firm* — Ling Wu; Stephen Yang; Ling and Yang Intellectual Property

(57) ABSTRACT

The invention provides a dipole antenna and mobile communication terminal. The dipole antenna comprises a first vibrator, a second vibrator, a feed terminal and a dielectric slab, the first vibrator and the second vibrator being provided anti-symmetrically on the dielectric slab, wherein the first vibrator comprises a first resonant ring configured to transmit and receive radio signals in a GSM900 band and a first antenna arm configured to transmit and receive radio signals in a DCS1800 band, the first antenna arm being connected to the first resonant ring; the second vibrator comprises a second resonant ring configured to transmit and receive radio signals in the GSM900 band and a second antenna arm configured to transmit and receive radio signals in the DCS1800 band, the second antenna arm being connected to the second resonant ring; the first antenna arm is connected to the second antenna arm through the feed terminal.

18 Claims, 2 Drawing Sheets

(56) References Cited

U.S. PATENT DOCUMENTS

| | | | | |
|---|---|---|---|---|
| 6,285,342 | B1 | 9/2001 | Brady et al. | |
| 6,624,793 | B1 | 9/2003 | Su et al. | |
| 7,019,704 | B2 * | 3/2006 | Weiss | 343/770 |
| 7,042,415 | B2 * | 5/2006 | Cheng | 343/795 |
| 7,505,000 | B2 * | 3/2009 | Hockey et al. | 343/700 MS |
| 7,548,207 | B1 | 6/2009 | Chu et al. | |
| 7,692,599 | B2 * | 4/2010 | Wong et al. | 343/795 |
| 2007/0013585 | A1 | 1/2007 | Wang et al. | |
| 2007/0046557 | A1 | 3/2007 | Chen et al. | |
| 2008/0122732 | A1 | 5/2008 | Gustafson et al. | |

FOREIGN PATENT DOCUMENTS

| | | | |
|---|---|---|---|
| EP | 1158606 | A1 | 11/2001 |
| EP | 1271692 | A1 | 1/2003 |
| EP | 1414109 | A2 | 4/2004 |
| JP | 2001308636 | A | 11/2001 |

* cited by examiner

DIPOLE ANTENNA AND MOBILE COMMUNICATION TERMINAL

TECHNICAL FIELD

The present invention relates to an antenna, and more particularly, to an ultra-wideband printed circuit slab (PCB) dipole antenna and a mobile communication terminal.

BACKGROUND OF THE RELATED ART

With the increasing development of communication technology, plenty of terminal products appear, and there are various forms of terminal antennas, among which monopole antennas are a kind of wireless terminal antenna structures that are currently most widely used.

Although the efficiency of a monopole antenna is relatively high and its volume is relatively small, its largest drawback lies in that the monopole antenna has a very close relationship with a motherboard and is greatly affected by the motherboard. Moreover, basically a lot of monopole antennas are in one-to-one correspondence with terminals, thus the versatility of the monopole antennas is not high.

SUMMARY OF THE INVENTION

In order to solve the aforementioned problem, an object of the present invention is to provide a dipole antenna and a mobile communication terminal, where the dipole antenna has a simple structure, certain versatility, and also dual-routing ultra-wideband performance so as to achieve a multi-frequency point working mode.

In order to achieve the aforementioned object, the technical scheme of the present invention is accomplished as follows.

The present invention provides a dipole antenna comprising a first vibrator, a second vibrator, a feed terminal and a dielectric slab, the first vibrator and the second vibrator being provided anti-symmetrically on the dielectric slab, wherein the first vibrator comprises:

a first resonant ring configured to transmit and receive radio signals in a GSM900 (global system for mobile communication) band; and a first antenna arm configured to transmit and receive radio signals in a DCS1800 (digital cellular system) band, the first antenna arm being connected to the first resonant ring;

the second vibrator comprises:

a second resonant ring configured to transmit and receive radio signals in the GSM900 band; and a second antenna arm configured to transmit and receive radio signals in the DCS1800 band, the second antenna arm being connected to the second resonant ring;

the first antenna arm is connected to the second antenna arm through the feed terminal.

The first resonant ring and the second resonant ring are annular in shape.

The first resonant ring is connected tangentially to the first antenna arm, and the second resonant ring is connected tangentially to the second antenna arm.

The first vibrator also comprises a first support arm, one end of which is connected to the first resonant ring, and the other end is connected to the first antenna arm; and the second vibrator also comprises a second support arm, one end of which is connected to the second resonant ring, and the other end is connected to the second antenna arm.

The first antenna arm and the second antenna arm are in the shape of a rectangular strip or L-shaped strip.

The feed terminal achieves feed from the first antenna arm to the second antenna arm through a coaxial line or microstrip line.

The present invention further provides a mobile communication terminal comprising an enclosure, a wireless module and a dipole antenna positioned in the enclosure, wherein the wireless module is connected to the dipole antenna and is configured to provide and process radio signals; and the dipole antenna comprises a first vibrator, a second vibrator, a feed terminal and a dielectric slab, wherein the first vibrator and the second vibrator are provided anti-symmetrically on the dielectric slab, the first vibrator comprises:

a first resonant ring configured to transmit and receive radio signals in a GSM900 (global system for mobile communication) band; and a first antenna arm configured to transmit and receive radio signals in a DCS1800 (digital cellular system) band, the first antenna arm being connected to the first resonant ring;

the second vibrator comprises:

a second resonant ring configured to transmit and receive radio signals in the GSM900 band; and a second antenna arm configured to transmit and receive radio signals in the DCS1800 band, the second antenna arm being connected to the second resonant ring;

the first antenna arm is connected to the second antenna arm through the feed terminal.

The first resonant ring and the second resonant ring are annular in shape.

The first resonant ring is connected tangentially to the first antenna arm, and the second resonant ring is connected tangentially to the second antenna arm.

The first vibrator also comprises a first support arm, one end of which is connected to the first resonant ring, and the other end is connected to the first antenna arm;

the second vibrator also comprises a second support arm, one end of which is connected to the second resonant ring, and the other end is connected to the second antenna arm.

It can be seen from the above technical scheme that the dipole antenna in accordance with the present invention has the following beneficial effects:

1) The first resonant ring and the second resonant ring in the dipole antenna are used for GSM900 band resonance, and the first antenna arm and the second antenna arm are used for DCS1800 band resonance. Since cross-polarization coupling effect occurs between the first resonant ring and the first antenna arm as well as between the second resonant ring and second antenna arm, the bandwidth of the dipole antenna can be extended effectively.

2) The shape of the first resonant ring and the second resonant ring in the dipole antenna can be chosen to be annular, and the annular first resonant ring and second resonant ring having relatively wide bandwidth are mainly used for the GSM900 band resonance. Due to bandwidth characteristics of the annular structure, interfere from the motherboard can be avoided, and serious deterioration of standing wave indexes caused by shift of the resonant band of the antenna is further avoid. Moreover, the first antenna arm and the second antenna arm can be in the shape of a rectangular strip and can be connected tangentially to the first resonant ring and the second resonant ring respectively, thus the interference between the first resonant ring and the first antenna arm as well as between the second resonant ring and the second antenna arm can be decreased effectively.

3) The first vibrator and the second vibrator in the dipole antenna are provided anti-symmetrically on the dielectric slab to effectively reduce the interference between the first antenna arm and the second antenna arm.

4) The dipole antenna in the form of a PCB dipole has, on the one hand, relatively good gain and omni-directivity, and on the other hand, the dipole antenna has a simple structure and can be fabricated by printing, thus it is suitable for bulk production, has low cost and has certain versatility.

5) The dipole antenna has dual routing ultra-wideband performance and can achieve a multi-frequency point working mode.

PREFERRED EMBODIMENTS OF THE PRESENT INVENTION

In order for those skilled in the art to better understand the scheme of the present invention, examples of the present invention will be further described in detail below in conjunction with the accompanying drawings and embodiments.

Figure 1:
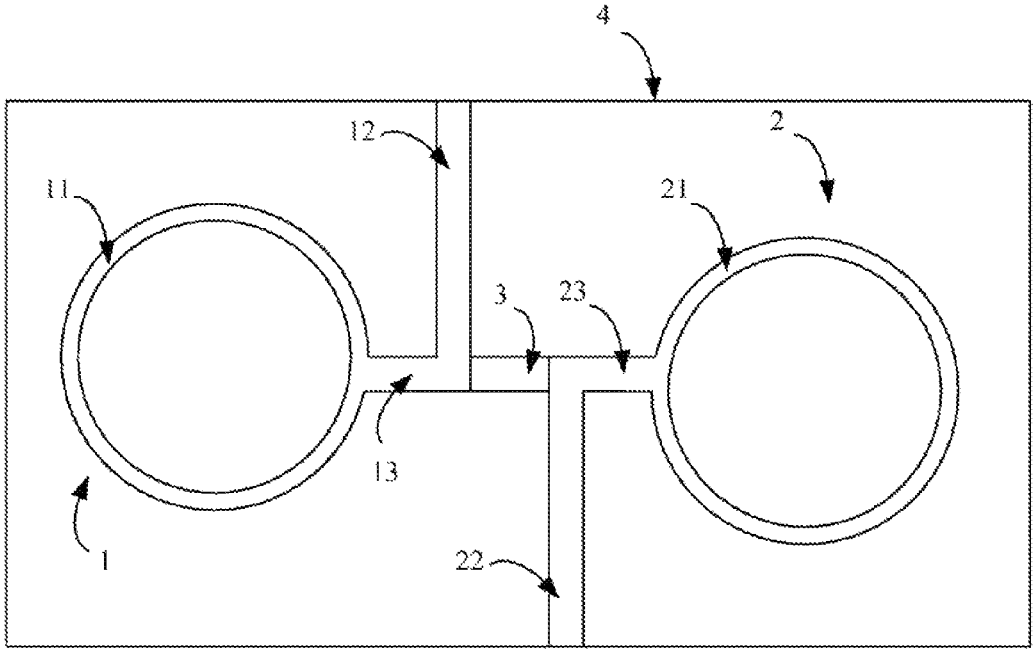
FIG. 1 is a structure diagram of a dipole antenna in accordance with the first embodiment of the present invention.

FIG. 1 is a structure diagram of a dipole antenna in accordance with the first embodiment of the present invention. It can be seen from FIG. 1 that the dipole antenna comprises a first vibrator 1, a second vibrator 2, a feed terminal 3 and a dielectric slab 4. The first vibrator 1 and the second vibrator 2 are provided anti-symmetrically on the dielectric slab 4 (referring to FIG. 1 and FIG. 3, the specific setting mode is shown, and anti-symmetry means that the second vibrator is obtained by Y-axis and X axis mirroring of the first vibrator 1 in turn in a plane, wherein the first vibrator 1 and the second vibrator 2 are anti-symmetrical).

The first vibrator 1 comprises a first resonant ring 11 and a second resonant ring 12.

The first resonant ring 11 is configured to transmit and receive radio signals in the GSM900 band (global system for mobile communication band). The shape of the resonant ring 11 can be annular and is not limited in this embodiment, it, for example, might be rectangular or oval.

The first antenna arm 12 is configured to transmit and receive radio signals in the DCS1800 band (digital cellular system band) and is connected to the first resonant ring 11. The first antenna arm 12 might be in the shape of a rectangular strip and its specific shape is not limited in this embodiment, it, for example, might be in the shape of an L-shaped strip.

The second vibrator 2 comprises a second resonant ring 21 and a second antenna arm 22.

The second resonant ring 21 is configured to transmit and receive radio signals in the GSM900 band. The shape of the second resonant ring 21 can be annular and is not limited in this embodiment, it, for example, might be rectangular or oval.

The second antenna arm 22 is configured to transmit and receive radio signals in the DCS1800 band, and is connected to the second resonant ring 21. The second antenna arm 22 is in the shape of a rectangular strip and its specific shape is not limited in this embodiment, it, for example, might be in the shape of an L-shaped strip.

The first antenna arm 12 is connected to the second antenna arm 22 through the feed terminal 3, which achieves feed from the first antenna arm 12 to the second antenna arm 22 using a coaxial line or a microstrip line. In the case of using the coaxial line, on the one hand, the distance between the dipole antenna and the motherboard can be increased by lengthening the coaxial line, and on the other hand, the dipole antenna can also be installed on a cover of a fixed station and the like, thus the product space is reduced, and the dipole antenna can be placed according to the actual space to meet requirements of different polarized waves.

In this embodiment, a dielectric layer of the dielectric slab 4 is a FR4 material (epoxy glass cloth laminated sheet with thickness specification being more than 0.1 mm mainly used for fixture production, software reinforcing materials, and electrical insulation pads), and the length of the dielectric layer is 10 cm, the width of the dielectric layer is 5 cm, and the thickness of the dielectric layer is 2 mm. Of course, in this embodiment, the first vibrator 1 and the second vibrator 2 can be provided on a FPC (flexible printed circuit board), thus the size of the dipole antenna can be decreased and the dipole antenna can be applied to a mobile communication terminal with smaller volume.

In this embodiment, if the first resonant ring 11 and the second resonant ring 21 are annular in shape, the inner diameter of the annular ring is 20 mm, and the outer diameter is 22 mm; if the first antenna arm 12 and the second antenna arm 22 are rectangular in shape, the length of the rectangle is 33 mm and the width is 2 mm.

In this embodiment, the first resonant ring 11 might be connected tangentially to the first antenna arm 12, and the second resonant ring 21 might be connected tangentially to the second antenna arm 22. The interference between the first resonant ring 11 and the first antenna arm 12 as well as the interference between the second resonant ring 21 and the second antenna arm 22 can be reduced through the tangent connection.

Of course, the first vibrator 1 might also comprise a first support arm 13, one end of which is connected to the first resonant ring 11, and the other end is connected to the first antenna arm 12.

The second vibrator 2 might also comprise a second support arm 23, one end of which is connected to the second resonant ring 21, and the other end is connected to the second antenna arm 22.

Figure 2:
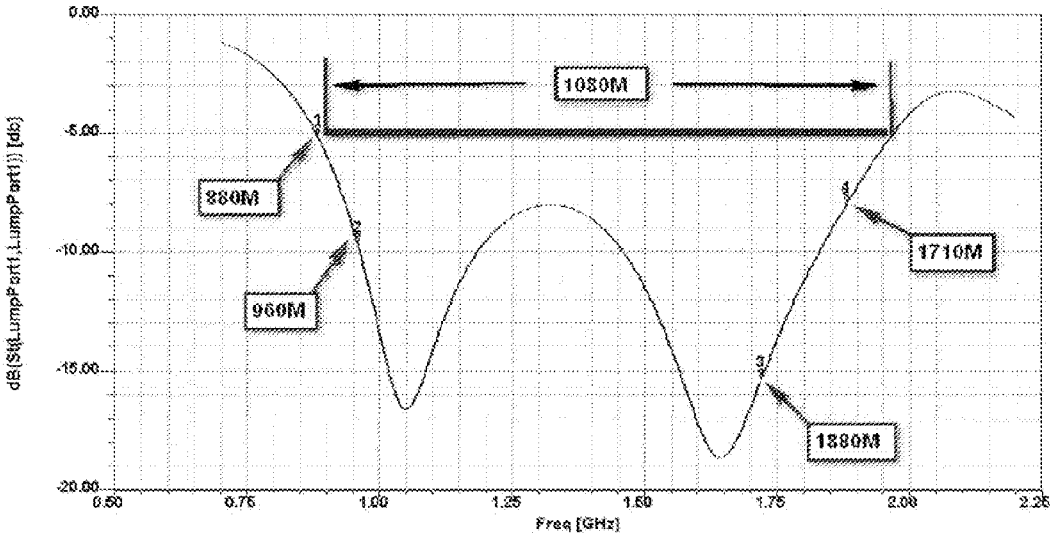
FIG. 2 is a schematic diagram of a reflection coefficient of the dipole antenna in accordance with the first embodiment of the present invention.

Referring to FIG. 2, a schematic diagram of a reflection coefficient of the dipole antenna in accordance with the first embodiment of the present invention is shown. It can be seen from FIG. 2 that the reflection coefficient of the dipole antenna structure in the GSM900 band in this embodiment can be below −12 dB, the reflection coefficient in the DCS1800 band is below −7 dB as well, and the band is relatively wide so as to achieve a four-frequency working mode.

Figure 3:
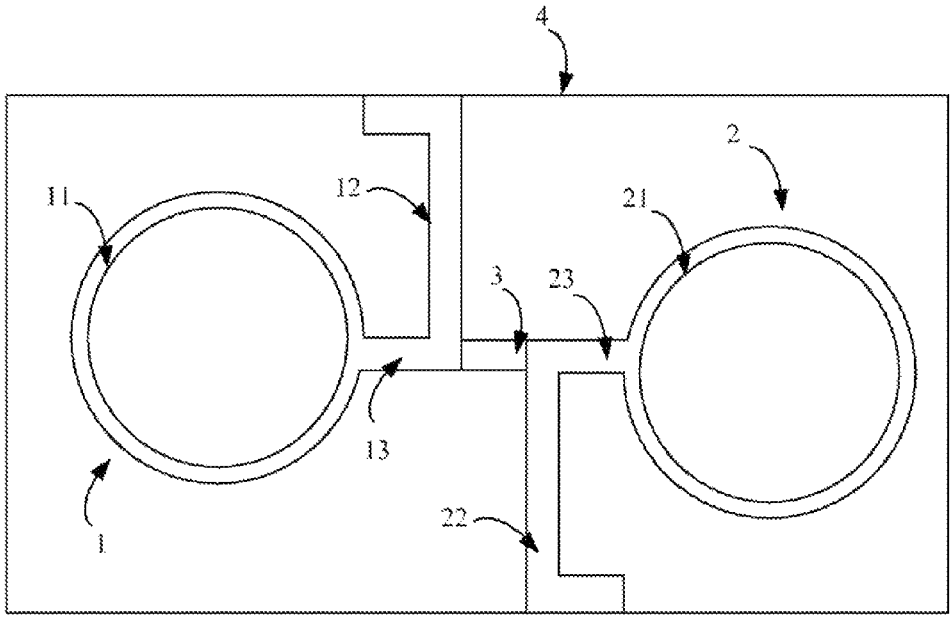
FIG. 3 is a structure diagram of a dipole antenna in accordance with the second embodiment of the present invention.

FIG. 3 is a structure diagram of a dipole antenna in accordance with the second embodiment of the present invention. The difference between the dipole antenna structure in FIG. 3 and that in FIG. 1 is that the first antenna arm 12 and the second antenna arm 22 in FIG. 3 are bent respectively so as to control the overall size of the dipole antenna effectively through the bending processing.

Figure 4:
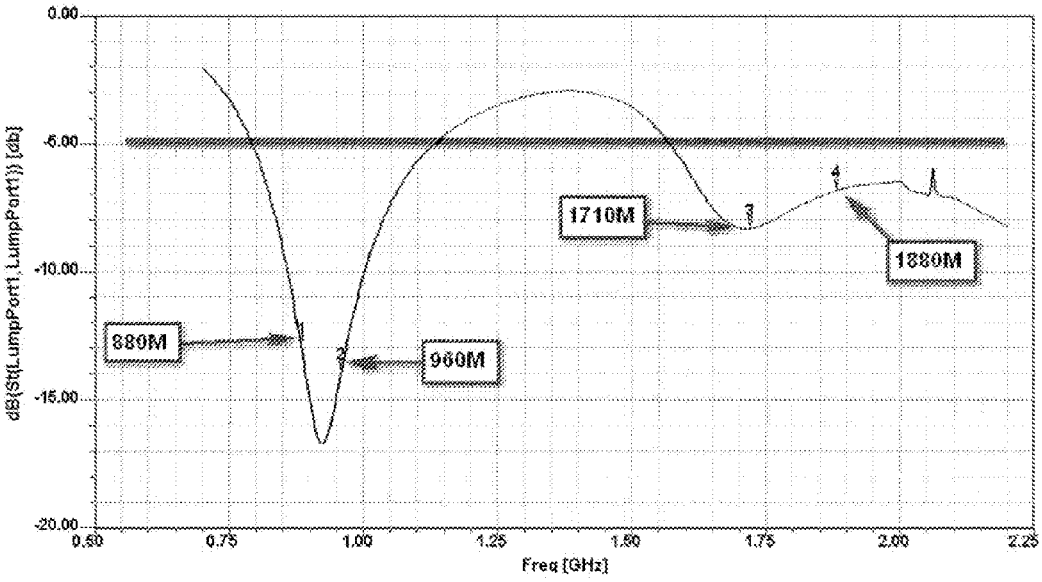
FIG. 4 is a schematic diagram of a reflection coefficient of the dipole antenna in accordance with the second embodiment of the present invention.

FIG. 4 is a schematic diagram of a reflection coefficient of the dipole antenna in accordance with the second embodiment of the present invention. It can be seen from FIG. 2 that the reflection coefficient of the dipole antenna structure in the GSM900 band in this embodiment can be below −12 dB, the reflection coefficient in the DCS1800 band is below −7 dB as well, and the band is relatively wide so as to achieve a four-frequency working mode.

It can be seen from the technical scheme described above that the dipole antenna in accordance with the present invention has the following beneficial effects:

1) Since the first resonant ring and the second resonant ring in the dipole antenna are used for the GSM900 band resonance, and the first antenna arm and the second antenna arm are used for the DCS1800 band resonance, and cross-polarization coupling effect occurs between the first resonant ring and the first antenna arm as well as between the second resonant ring and second antenna arm, the bandwidth of the dipole antenna can be extended effectively. The bandwidth of the dipole antenna in FIG. 1 is about 1080 MHz when a voltage standing wave ratio (VSWR)<−5 dB such that the dipole antenna has ultra-wideband performance.

2) The existing mobile phones, fixed stations and the like are commonly linearly polarized, the routing is relatively simple, and the antenna structure generally is composed of regular rectangular or irregular strips, usually the low frequency bandwidth is narrow. In this embodiment, the shape of the first resonant ring and the second resonant ring in the dipole antenna can be chosen to be annular, and the annular first resonant ring and second resonant ring having relatively wide bandwidth are mainly used for the GSM900 band resonance. Due to bandwidth characteristics of the annular structure, interfere from the motherboard can be avoided, and serious deterioration of standing wave indexes caused by shift of the resonant band of the antenna is further avoid. Moreover, the first antenna arm and the second antenna arm can be in the shape of a rectangular strip and can be connected tangentially to the first resonant ring and the second resonant ring respectively, thus the interference between the first resonant ring and the first antenna arm as well as between the second resonant ring and the second antenna arm can be decreased effectively. On the other hand, coupling effect will occur between the first resonant ring and the first antenna arm as well as between the second resonant ring and the second antenna arm, resulting in resonance at other frequency points, and function of the dipole antenna is equivalent to that of a multi-branch structure, thus the bandwidth of the dipole antenna is expanded.

3) The first vibrator and the second vibrator in the dipole antenna are provided anti-symmetrically on the dielectric slab such that currents in the first antenna arm and the second antenna arm are in opposite directions and cancel each other out, and the radiated power in the DCS1800 band is decreased, thereby effectively reducing the interference between the first antenna arm and the second antenna arm.

4) The dipole antenna in the form of a PCB dipole has, on the one hand, relatively good gain and omni-directivity, and on the other hand, the dipole antenna has a simple structure and can be fabricated by printing, thus it is suitable for bulk production, has low cost and has certain versatility.

5) The dipole antenna has dual routing ultra-wideband performance and can achieve multi-frequency point working mode.

An embodiment also provides a mobile communication terminal comprising an enclosure, a wireless module and a dipole antenna positioned in the enclosure.

The wireless module is connected to the dipole antenna and is configured to provide and process radio signals.

The dipole antenna comprises a first vibrator, a second vibrator, a feed terminal and a dielectric slab, wherein the first vibrator and the second vibrator are provided anti-symmetrically on the dielectric slab.

The first vibrator comprises:

a first resonant ring configured to transmit and receive radio signals in a GSM900 (global system for mobile communication) band; and a first antenna arm configured to transmit and receive radio signals in a DCS1800 (digital cellular system) band, the first antenna arm being connected to the first resonant ring.

The second vibrator comprises:

a second resonant ring configured to transmit and receive radio signals in the GSM900 band; and a second antenna arm configured to transmit and receive radio signals in the DCS1800 band, the second antenna arm being connected to the second resonant ring.

The first antenna arm is connected to the second antenna arm through the feed terminal.

In this embodiment, the first resonant ring and the second resonant ring are annular in shape.

In this embodiment, the first resonant ring is connected tangentially to the first antenna arm, and the second resonant ring is connected tangentially to the second antenna arm.

In this embodiment, the first vibrator also comprises a first support arm, one end of which is connected to the first resonant ring, and the other end is connected to the first antenna arm.

The second vibrator also comprises a second support arm, one end of which is connected to the second resonant ring, and the other end is connected to the second antenna arm.

It should be noted that in practical applications, the numbers of the resonant rings, the antenna arms and the support arms described above might change with different application scenarios, and thus may be different from the corresponding numbers hereinabove. In fact, the numbers can change in any way, as long as the resonant rings, antenna arms and support arms can cause the first vibrator, the second vibrator, the feed terminal and the dielectric slab to cooperate with each other according to the proper connection relationship described above to form a high-performance dipole antenna and mobile communication terminal. Specifically, the dipole antenna has a simple structure and certain versatility, and also dual-routing ultra-wideband performance so as to achieve a multi-frequency point working mode.

The above description is only the preferred embodiments of the present invention. It should be noted that various improvements and modifications to the present invention may be made by those skilled in the art without departing from the principle of the present invention. These improvements and modifications should be regarded as the protection scope of the present invention.

What is claimed is:

1. A dipole antenna comprising a first vibrator, a second vibrator, a feed terminal and a dielectric slab, the first vibrator and the second vibrator being provided anti-symmetrically on the dielectric slab, wherein the first vibrator comprises:

a first resonant ring configured to transmit and receive radio signals in a GSM900 (global system for mobile communication) band; and a first antenna arm configured to transmit and receive radio signals in a DCS1800 (digital cellular system) band, the first antenna arm being connected to the first resonant ring;

the second vibrator comprises:

a second resonant ring configured to transmit and receive radio signals in the GSM900 band; and a second antenna arm configured to transmit and receive radio signals in the DCS1800 band, the second antenna arm being connected to the second resonant ring;

the first antenna arm is connected to the second antenna arm through the feed terminal.

2. The dipole antenna according to claim 1, wherein the first resonant ring and the second resonant ring are annular in shape.

3. The dipole antenna according to claim 2, wherein the first resonant ring is connected tangentially to the first antenna arm, and the second resonant ring is connected tangentially to the second antenna arm.

4. The dipole antenna according to claim 3, wherein the first vibrator further comprises a first support arm, one end of which is connected to the first resonant ring, and the other end is connected to the first antenna arm; and the second vibrator further comprises a second support arm, one end of which is connected to the second resonant ring, and the other end is connected to the second antenna arm.

5. The dipole antenna according to claim 3, wherein the first antenna arm and the second antenna arm are in the shape of a rectangular strip or L-shaped strip.

6. The dipole antenna according to claim 3, wherein the feed terminal achieves feed from the first antenna arm to the second antenna arm through a coaxial line or microstrip line.

7. The dipole antenna according to claim 2, wherein the first vibrator further comprises a first support arm, one end of which is connected to the first resonant ring, and the other end is connected to the first antenna arm; and the second vibrator further comprises a second support arm, one end of which is connected to the second resonant ring, and the other end is connected to the second antenna arm.

8. The dipole antenna according to claim 2, wherein the first antenna arm and the second antenna arm are in the shape of a rectangular strip or L-shaped strip.

9. The dipole antenna according to claim 2, wherein the feed terminal achieves feed from the first antenna arm to the second antenna arm through a coaxial line or microstrip line.

10. The dipole antenna according to claim 1, wherein the first vibrator further comprises a first support arm, one end of which is connected to the first resonant ring, and the other end is connected to the first antenna arm; and the second vibrator further comprises a second support arm, one end of which is connected to the second resonant ring, and the other end is connected to the second antenna arm.

11. The dipole antenna according to claim 1, wherein the first antenna arm and the second antenna arm are in the shape of a rectangular strip or L-shaped strip.

12. The dipole antenna according to claim 1, wherein the feed terminal achieves feed from the first antenna arm to the second antenna arm through a coaxial line or microstrip line.

13. A mobile communication terminal comprising an enclosure, a wireless module and a dipole antenna positioned in the enclosure, wherein the wireless module is connected to the dipole antenna and is configured to provide and process radio signals; and the dipole antenna comprises a first vibrator, a second vibrator, a feed terminal and a dielectric slab, wherein the first vibrator and the second vibrator are provided anti-symmetrically on the dielectric slab, the first vibrator comprises:

a first resonant ring configured to transmit and receive radio signals in a GSM900 (global system for mobile communication) band; and a first antenna arm configured to transmit and receive radio signals in a DCS1800 (digital cellular system) band, the first antenna arm being connected to the first resonant ring;

the second vibrator comprises:

a second resonant ring configured to transmit and receive radio signals in the GSM900 band; and a second antenna arm configured to transmit and receive radio signals in the DCS1800 band, the second antenna arm being connected to the second resonant ring;

the first antenna arm is connected to the second antenna arm through the feed terminal.

14. The mobile communication terminal according to claim 13, wherein the first resonant ring and the second resonant ring are annular in shape.

15. The mobile communication terminal according to claim 14, wherein the first resonant ring is connected tangentially to the first antenna arm, and the second resonant ring is connected tangentially to the second antenna arm.

16. The mobile communication terminal according to claim 15, wherein the first vibrator further comprises a first support arm, one end of which is connected to the first resonant ring, and the other end is connected to the first antenna arm; and the second vibrator further comprises a second support arm, one end of which is connected to the second resonant ring, and the other end is connected to the second antenna arm.

17. The mobile communication terminal according to claim 14, wherein the first vibrator further comprises a first support arm, one end of which is connected to the first resonant ring, and the other end is connected to the first antenna arm; and the second vibrator further comprises a second support arm, one end of which is connected to the second resonant ring, and the other end is connected to the second antenna arm.

18. The mobile communication terminal according to claim 13, wherein the first vibrator further comprises a first support arm, one end of which is connected to the first resonant ring, and the other end is connected to the first antenna arm; and the second vibrator further comprises a second support arm, one end of which is connected to the second resonant ring, and the other end is connected to the second antenna arm.

* * * * *